US006782854B2

(12) United States Patent
Nakamura et al.

(10) Patent No.: US 6,782,854 B2
(45) Date of Patent: Aug. 31, 2004

(54) VALVE TIMING CONTROL DEVICE

(75) Inventors: Motoo Nakamura, Toyota (JP); Shigeru Nakajima, Anjo (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/649,619

(22) Filed: Aug. 28, 2003

(65) Prior Publication Data

US 2004/0074458 A1 Apr. 22, 2004

(30) Foreign Application Priority Data

Aug. 28, 2002 (JP) ..... 2002-249249

(51) Int. Cl.[7] ..... F01L 1/34

(52) U.S. Cl. ..... 123/90.17; 123/90.15; 123/90.16; 123/90.31

(58) Field of Search ..... 123/90.15, 90.16, 123/90.17, 90.18, 90.27, 90.31; 464/1, 2, 160

(56) References Cited

U.S. PATENT DOCUMENTS 5,937,810 A * 8/1999 Sato et al. ..... 123/90.17
6,039,015 A 3/2000 Sato
6,053,138 A * 4/2000 Trzmiel et al. ..... 123/90.17
6,173,686 B1 * 1/2001 Nakayoshi et al. ..... 123/90.17

FOREIGN PATENT DOCUMENTS

JP 11-101107 9/1997

* cited by examiner

*Primary Examiner*—Thomas Denion
*Assistant Examiner*—Ching Chang
(74) *Attorney, Agent, or Firm*—Reed Smith LLP; Stanley P. Fisher, Esq.; Juan Carlos A. Marquez, Esq.

(57) ABSTRACT

A valve timing control device includes a rotation member for opening and closing values, a rotation transmitting member rotatably mounted on the rotation member, a fluid chamber defined between the rotation member and the rotation transmitting member, a vane fitted into a vane groove formed on the rotation member or the rotation transmitting member so as to divide the fluid chamber into a advance angle pressure chamber and a retard angle pressure chamber, the vane groove having contacting portions contacted with the vane and an elastic member disposed between the vane and the rotation member or the rotation transmitting member, wherein the radial length between the bottom portion of the vane groove and a bottom portion side end portion of the contacting portion is larger than a radial length between the bottom portion of the vane groove and an engaging portion of the vane engaged with the elastic member.

4 Claims, 3 Drawing Sheets

VALVE TIMING CONTROL DEVICE

CROSS REFERENCE TO RELATED APPLICATIONS

This application is based on and claims priority to Japanese Patent Application No. 2002-249249 filed on Aug. 28, 2002, the entire content of which is incorporated herein by reference.

FIELD OF THE INVENTION

The present invention relates to a valve timing control device which controls open and close timing of intake or exhaust valves of a combustion engine.

BACKGROUND OF THE INVENTION

A conventional device of this kind is disclosed, for example, in Japanese Patent Laid-Open Publication No. 11-101107. This device is disposed between a crank shaft of a combustion engine and a cam shaft for opening and dosing intake or exhaust valves and controls open and close timing of intake or exhaust valves independently of the rotation of the crank shaft.

This device includes a timing sprocket which rotates with the crank shaft in a body, a housing which rotates with the timing sprocket in a body, a rotor which rotates relative to the housing and which operates the cam shaft and a vane which divides a fluid chamber formed between the rotor and the housing into an advance angle pressure chamber and a retard angle pressure chamber and which regulates the amount of the relative rotation between the rotor and the housing by the contact with end surfaces of a shoe portions formed on the housing. The vane is fitted into a vane groove which is formed on the rotor in the radial direction and rotates with the rotor in a body. Contacting portions are formed on the vane groove between a bottom portion and an opening end thereof and the rotational force is transmitted from the vane to the rotor through the contacting portions when the pressure difference is generated between the advance angle pressure chamber and the retard angle pressure chamber. A concave portion is formed on a radial inner end portion of the vane and a vane spring is disposed between the concave portion and the bottom portion the vane groove. The vane spring urges the vane outwardly in the radial direction so that a radial outer end of the vane slides on an inner wall of the fluid chamber.

In the above described device, however, a contacting area between the vane and a contacting portion of the vane groove is decreased by the concave portion of the valve. When the vane rotates with the rotor by the pressure difference between the advance angle pressure chamber and the retard angle pressure chamber, a driving force is applied to the vane due to the pressure difference and a load corresponding to the driving force is applied to the contacting portion of the vane groove. Further, when the vane regulates the relative rotation between the rotor and the housing by the contact with the end surfaces of the shoe portions, a reaction force is applied to the vane and a load corresponding to the reaction force is applied to the contacting portion of the vane groove. Therefore, in case that a radial length between the bottom portion of the vane groove and the radial inner end of the contacting portion is smaller than a radial length between the bottom portion of the vane groove and the concave portion, the surface pressure of the contacting portion increases and there is in danger that the contacting portions are worn.

SUMMARY OF THE INVENTION

It is, therefore, an object of the present invention to overcome the above drawback.

In order to achieve the foregoing object, the present invention provides a valve timing control device which includes a rotation member for opening and closing valves, a rotation transmitting member rotatably mounted on the rotation member, a fluid chamber defined between the rotation member and the rotation transmitting member, a vane fitted into a vane groove formed on the rotation member or the rotation transmitting member so as to divide the fluid chamber into a advance angle pressure chamber and a retard angle pressure chamber, the vane groove having contacting portions contacted with the vane and an elastic member dispose between the vane and the rotation member or the rotation transmitting member, wherein the radial length between the bottom portion of the vane groove and a bottom portion side end portion of the contacting portion is larger than a radial length been the bottom portion of the vane groove and an engaging portion of the vane engaged with the elastic member.

BRIEF DESCRIPTION OF THE DRAWINGS

The above and other objects, features and advantages of the present invention will be more apparent and more readily appreciated from the following detailed description of a preferred exemplary embodiment of the present invention, taken in connection with the accompanying drawings, in which.

DETAILED DESCRIPTION OF THE PRESENT INVENTION

Figure 1:
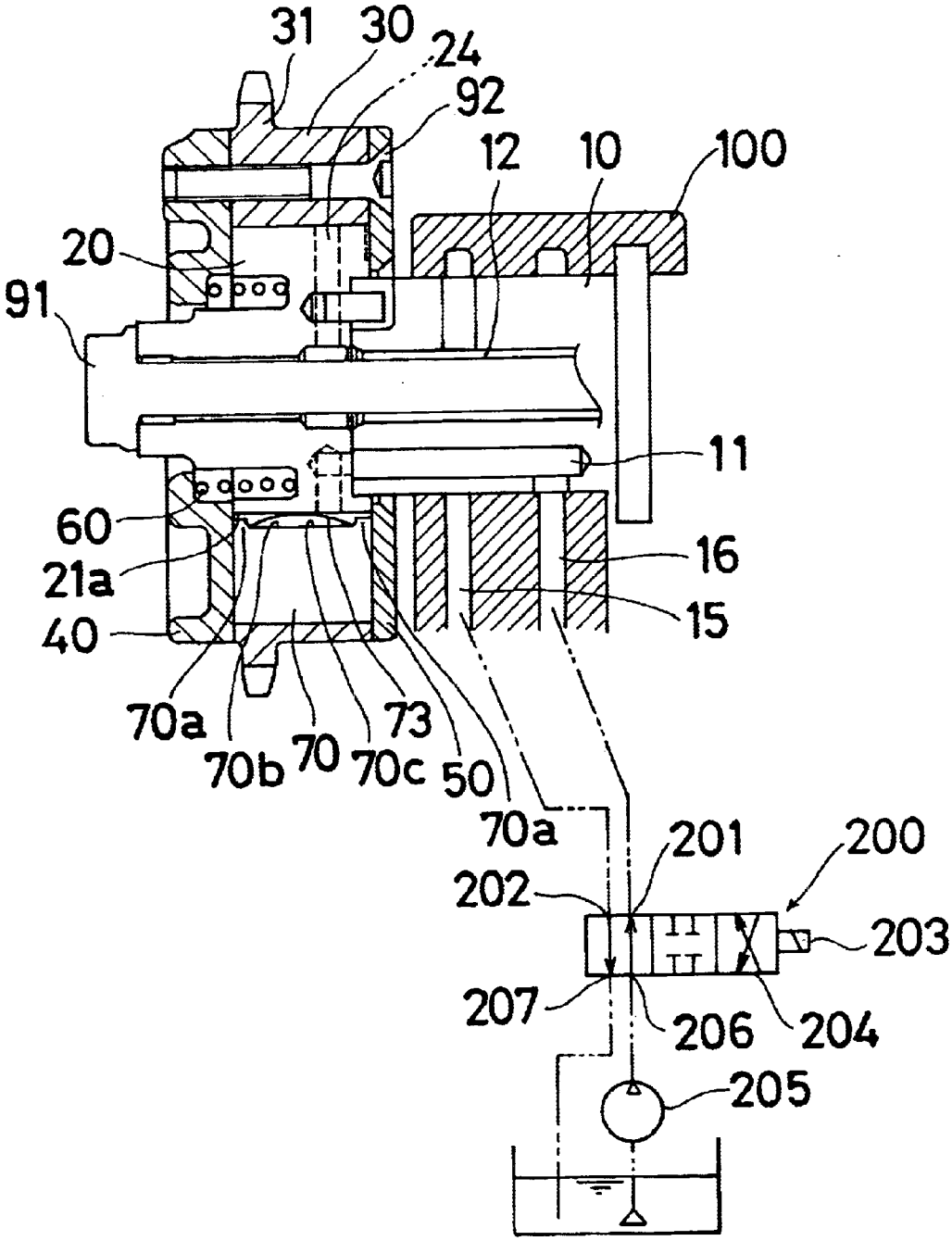
FIG. 1 shows a sectional view of an embodiment of a valve timing control device in accordance with the present invention.
Figure 2:
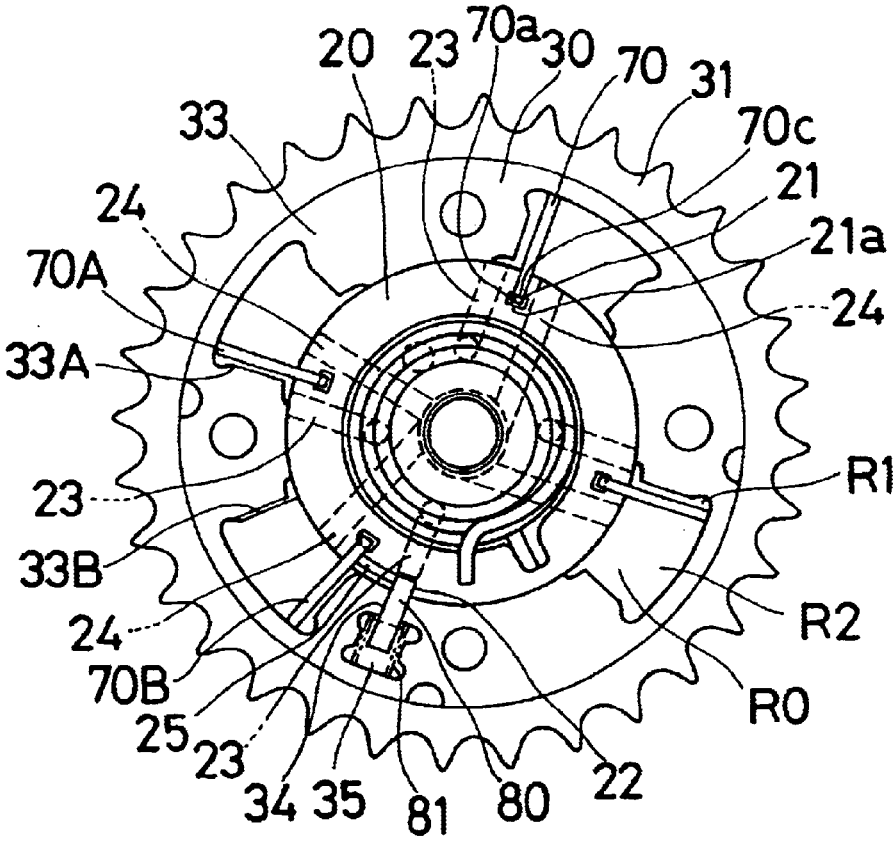
FIG. 2 shows a front view of the embodiment under the condition which a front plate is removed.

Referring to FIG. 1 and FIG. 2, a valve timing control device includes a rotation member comprising a rotor 20 which is fixedly mounted on a top end portion of a cam shaft 10 rotatably supported on a cylinder head 100 of a combustion engine, a rotation transmitting member comprising a housing 30 mounted on the rotor 20 so as to be able to rotate relative to the rotor 20 within a predetermined angle, a front plate 40, a rear plate 50 and a timing sprocket 31 integrally formed on the housing 30, four vanes 70 mounted on the rotor 20 and a lock key 80 disposed in the housing 30. The rotational torque is transmitted to the timing sprocket 31 via a crank sprocket and a timing chain (not shown) from a crank shaft (not shown) clockwise in FIG. 2.

The cam shaft 10 includes cams which open and close intake or exhaust valves (not shown). An advance angle passage 11 and a retard angle passage 12 which extend in the axial direction are formed in the cam shaft 10. The advance angle passage 11 is connected to a first connecting port 201 of a changeover valve 200 via a connection passage 16. The retard angle passage 12 is connected to a second connecting port 202 of the changeover valve 200 via a connection passage 15. The changeover valve 200 includes a well known structure in which a spool 204 is moved against a spring (not shown) by applying current to a solenoid 203. When the changeover valve 200 is not excited, a supply port 206 connected to an oil pump 205 driven by the combustion engine is communicated to the second connecting port 202 and the first connecting port 201 is communicated to a drain port 207. Further, when the changeover valve 200 is excited, as shown in FIG. 1, the supply port 206 is communicated to the first connecting port 201 and the second connecting port 202 is communicated to the drain port 207. Thereby, the pressurized fluid from the oil pump 205 is supplied to the retard angle passage 12 when the changeover valve 200 is not excited and the pressurized fluid from the oil pump 205 is supplied to the advance angle passage 11 when the changeover valve 200 is excited.

The rotor 20 is fixed to the cam shaft 10 by a single bolt 91 and includes four vane grooves 21, lock key groove 22, four radial advance angle passages 23, four radial retard angle passage 24 and a passage 25 which extends in the circumferential direction on the outer circumference of the rotor 20. A head portion of the lock key 80 is fitted into the lock key groove 22 when the relative position between the rotor 20 and the housing 30 becomes a predetermined relative phase (most retard angle position) shown in FIG. 2. The operation fluid is supplied to the lock key groove 22 from the advance angle passage 23 via the passage 25. The vanes 70 are fitted into the vane grooves 21 so as to be able to move in the radial direction. Contacting portions 21*b* are formed on the vane groove 21 between a bottom portion 21*a* and an opening end thereof and the rotational force is transmitted from the vane 70 to the rotor 20 through the contacting portions 21*b* when the vanes 70 and the rotor 20 rotate relative to the housing 30. A pair of projection portions 70*a* are formed on both axial ends of a bottom side end portion (a radial inner end portion) of each vane 70 and a concave portion 70*b* is formed between projection portions 70*a*, respectively. A flat plate shaped vane spring (elastic member) 73 is disposed between the bottom portion 70*a* and an engaging portion 70*c* formed on a bottom surface of the concave portion 70*b*, respectively. The vane springs 73 urge the vanes 70 outwardly in the radial direction so that a radial outer ends of the vanes 70 contact with the inner circumferential surface of the housing 30. The projecting portions 70*a* prevent the vane springs 73 from contacting with the front plate 40 and the rear plate 50.

Figure 3:
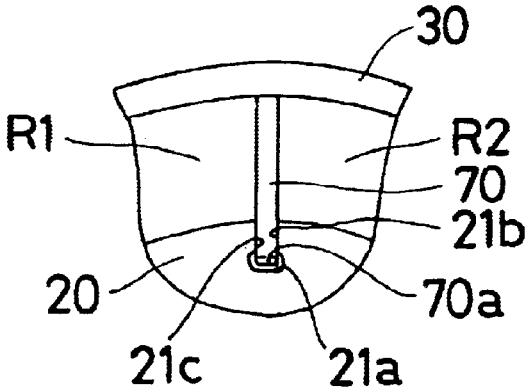
FIG. 3 shows an enlarged front view of a vane groove of the embodiment.
Figure 4:
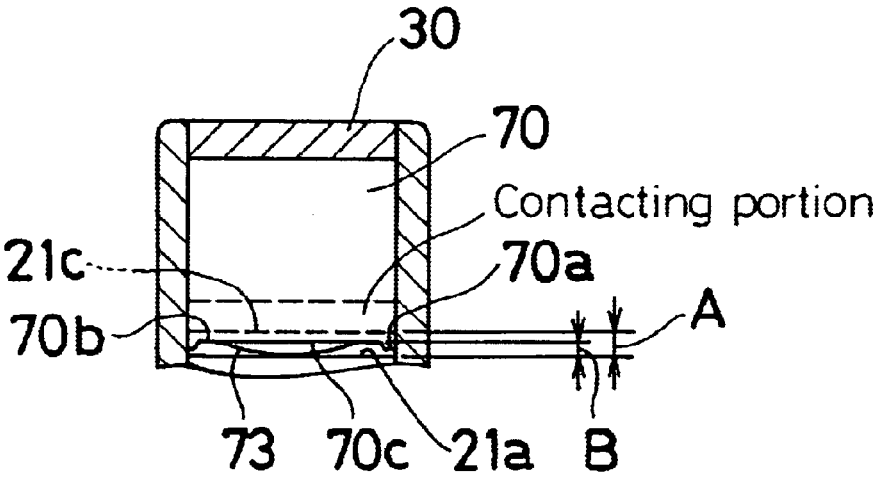
FIG. 4 shows an enlarged sectional view of the vane groove of the embodiment.

As shown in FIG. 3 and FIG. 4, the radial length (A) between the bottom portion 21*a* of the vane groove 21 and a bottom portion side end portion 21*c* of the contacting portion 21*b* is larger than a radial length (B) between the bottom portion 21*a* of the vane groove 21 and the engaging portion 70*c* of the vane 70. Thereby, since the contacting area between each vane 70 and rotor 20 can be increased, the surface pressure of the contacting portions 21*b* is decreased and the wear of the contacting portions 21*b* is prevented.

Figure 5A:
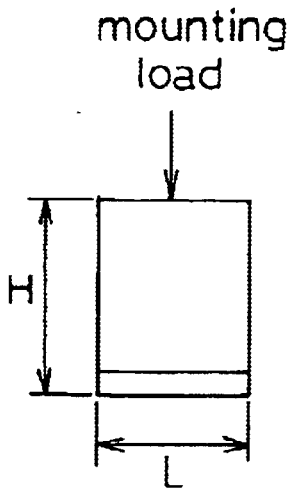
FIG. 5(*a*) and FIG. 5(*b*) show diagrams of the mounting condition of the vane spring of the embodiment.
Figure 5B:
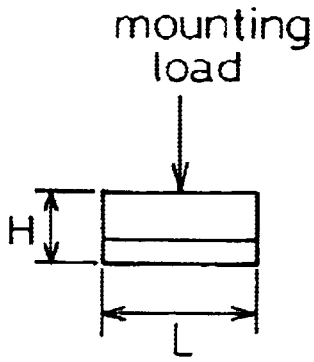

In this embodiment, the bottom portion 21*a* of the vane groove 21 has a flat surface shape. Thereby, the contact between the bottom portion 21*a* and the vane spring 73 becomes a line contact or a surface contact and the abrasion of the bottom portion 21*a* and the vane spring 73 can be prevented. Further, as shown in FIG. 5, in the mounting condition of the vane spring 73, a mounting length H of the vane spring 73 (a radial length between the bottom portion 21*a* of the vane groove 21 and the engaging portion 70*c*) is smaller than a width L of the vane spring 73. When the mounting length H is larger than the width L, the posture of the vane spring 73 at the mounting deteriorates, for example, the tumbling generates, and consequently it is not able to contact the radial outer ends of the vanes 70 to the inner circumference of the housing 30 with adequate load. In this embodiment, as mentioned above, since the mounting length H is set smaller than the width L, the load of the vane springs 73 can be stabilized.

The housing 30 is mounted on the outer circumference of the rotor 20 so as to be able to rotate relative to the rotor 20 within a predetermined angle. The circular front plate 40 and the circular rear plate 50 are fixed to both ends of the housing 30 by four bolts 92. Four shoe portions 33 are formed on the inner circumference of the housing 30. The inner circumferential surface of the shoe portions 33 contact with the outer circumferential surface of the rotor 20 so as to be able to slide in the circumferential direction. Thereby, the housing 30 is rotatably supported on the housing 30. In one of the shoe portions 33, a lock key refuging groove 34 in which the lock key 80 is disposed and a groove 35 in which a spring 81 urging the lock-key 80 in the radial direction is disposed and which communicates to the refuging groove 34 are formed.

A torsion spring 60 is disposed between the rotor 20 and the housing 30. On end of the torsion spring 60 is engaged with the front plate 40 and the other end thereof is engaged with the rotor 20. The torsion spring 60 urges always the rotor 20 toward the advance angle direction relative to the housing 30, the front plate 40 and the rear plate 50 and improves the response of the operation of the rotor 20 toward the advance angle direction.

Four fluid chambers R0 are formed by the rotor 20, the housing 30, the front plate 40 and the rear plate 50. Each vane 70 divides the fluid chamber R0 into a advance angle pressure chamber R1 and a retard angle pressure chamber R2, respectively. The amount of the relative rotation between the rotor 20 and the housing 30 depends on the circumferential width (angle) of the fluid chamber R0. At the most advance angle position, the vane 70A contacts with a circumferential surface of the shoe portion 33A and the rotation of the rotor 20 relative to the housing 30 in the advance angle direction is restricted. At the most retard angle position, the vane 70B contacts with a circumferential surface of the shoe portion 33B and the rotation of the rotor 20 relative to the housing 30 in the retard angle direction is restricted. At the most retard angle position, the head portion of the lock key 80 is fitted into the lock key groove 22 as shown in FIG. 2 and the relative rotation between the rotor 20 and the housing 30 is locked.

The operation of the valve timing control device having the above structure will now be described. When the duty ratio of current applied to the solenoid 203 of the changeover valve 200 is increased and the position of the spool 204 is changed, the operational fluid (hydraulic pressure) supplied from the oil pump 205 is supplied to the advance angle pressure chambers R1 via the supply port 206, the connecting port 201, the connecting passage 16, the advance angle passage 11 and passage 23. Further, the operational fluid (hydraulic pressure) supplied from the oil pump 205 is supplied from the passage 23 to the lock key groove 22. On the other hand, the operational fluid (hydraulic pressure) in the retard angle pressure chambers R2 is discharged from the drain port 207 of the changeover valve 200 via the passage 24, the retard angle passage 12, the connecting passage 15 and the connecting port 202. In this time, the lock key 80 moves against the spring 81 and the head portion thereof comes off from the lock key groove 22. Thereby, the lock condition between the rotor 20 and the housing 30 is released. Further, the rotor 20 and each vane 70 are rotated relative to the housing 30 and the plates 40, 50 toward the advance angle direction (clockwise).

In the condition which the lock key 80 comes off from the lock key groove 22, when the duty ratio of current applied to the solenoid 203 of the changeover valve 200 is decreased, the operation fluid can be supplied to the retard angle pressure chambers R2 and the operational fluid In the advance angle pressure chambers R1 can be discharged. Accordingly, it is able to adjust continuously the position of the rotor 20 and each vane 70 relative to the housing 30 and the plates 40, 50 toward any position between the most advance angle position and the most retard angle position shown in FIG. 2.

As mentioned above, according to the present Invention, since the contacting area between each vane and rotor can be increased, the surface pressure of the contacting portions is decreased and the wear of the contacting portions is prevented. Further, since the leak of the fluid via a clearance between the vane groove and the vane is decreased by the enlargement of the contacting area, the invasion of the hard particle in the fluid into the clearance is prevented and the wear of the vanes and vane grooves is prevented.

What is claimed is:

1. A valve timing control device comprising:

a rotation member for opening and closing valves, a rotation transmitting member rotatably mounted on the rotation member, a fluid chamber defined between the rotation member and the rotation transmitting member, a vane fitted into a vane groove formed on the rotation member or the rotation transmitting member so as to divide the fluid chamber into a advance angle pressure chamber and a retard angle pressure chamber, the vane groove having contacting portions contacted with the vane and an elastic member disposed between the vane and the rotation member or the rotation transmitting member, wherein the radial length between the bottom portion of the vane groove and a bottom portion side end portion of the contacting portion is larger than a radial length between the bottom portion of the vane groove and an engaging portion of the vane engaged with the elastic member.

2. A valve timing control device as recited in claim 1, wherein a pair of projection portions are formed on both axial ends of a bottom side end portion of each vane and a concave portion is formed between the projection portions, and the engaging portion is formed on a bottom of the concave portion.

3. A valve timing control device as recited in claim 2, wherein the bottom portion of the vane groove has a flat surface shape.

4. A valve timing control device as recited in claim 3, wherein a radial length between the bottom portion of the vane groove and the engaging portion is smaller than a width of the vane spring.

* * * * *